US009422936B2

(12) United States Patent
Park et al.

(10) Patent No.: US 9,422,936 B2
(45) Date of Patent: Aug. 23, 2016

(54) WATER PUMP IN VEHICLE

(71) Applicant: KAMTEC INC., Jincheon-gun (KR)

(72) Inventors: Seok Ryul Park, Jincheon-gun (KR); Ki Chang Shim, Jincheon-gun (KR); Ki Chul Lee, Jincheon-gun (KR)

(73) Assignee: KAMTEC INC., Jincheon-gun, Chungbuk (KR)

( * ) Notice: Subject to any disclaimer, the term of this patent is extended or adjusted under 35 U.S.C. 154(b) by 847 days.

(21) Appl. No.: 13/760,081

(22) Filed: Feb. 6, 2013

(65) Prior Publication Data

US 2013/0216355 A1 Aug. 22, 2013

(30) Foreign Application Priority Data

Feb. 20, 2012 (KR) ..... 10-2012-0017041

(51) Int. Cl.

| | |
|---|---|
| ***F04D 1/00*** | (2006.01) |
| ***F01P 5/12*** | (2006.01) |
| ***F04D 29/046*** | (2006.01) |
| ***F04D 13/06*** | (2006.01) |
| ***F04D 29/06*** | (2006.01) |
| ***F04D 29/58*** | (2006.01) |

(52) U.S. Cl.

CPC ... *F04D 1/00* (2013.01); *F01P 5/12* (2013.01); *F04D 13/0633* (2013.01); *F04D 29/0465* (2013.01); *F04D 29/061* (2013.01); *F04D 29/588* (2013.01); *F01P 2005/125* (2013.01)

(58) Field of Classification Search

CPC .... F01P 5/12; F04D 13/0633; F04D 29/0465; F04D 29/061; F04D 29/588

See application file for complete search history.

(56) References Cited

U.S. PATENT DOCUMENTS

| | | | | |
|---|---|---|---|---|
| 4,013,384 A * | 3/1977 | Oikawa | ..... | F04D 3/02 415/10 |
| 4,890,988 A * | 1/1990 | Kramer | ..... | F04D 15/0077 165/169 |
| 6,012,909 A * | 1/2000 | Sloteman | ..... | F04D 13/0666 415/58.2 |

(Continued)

FOREIGN PATENT DOCUMENTS

| | | |
|---|---|---|
| DE | 8717950 U1 | 8/1991 |
| EP | 0778649 A1 | 6/1997 |

(Continued)

OTHER PUBLICATIONS

European Search Report in Application No. 13154890.1 dated May 17, 2013.

*Primary Examiner* — Nathaniel Wiehe
*Assistant Examiner* — Woody Lee, Jr.
(74) *Attorney, Agent, or Firm* — Park, Kim & Suh, LLC

(57) ABSTRACT

The present invention relates to a water pump in a vehicle. The water pump in a vehicle includes a pump cover which forms an upper side exterior appearance of the pump for housing an impeller to be rotated, a hollow rotor coupled on the same axis with the impeller to rotate altogether, and a housing coupled to the pump cover to house the rotor and a stator therein, wherein the pump cover includes a first rotation shaft extended toward the hollow in the rotor passed through the impeller, the housing includes a second rotation shaft extended toward the hollow in the rotor, the first rotation shaft has a communication hole formed therein to be in communication with the hollow, and the rotor has a communication passage recessed in a lower end portion thereof to a predetermined depth.

20 Claims, 10 Drawing Sheets

(56) References Cited

U.S. PATENT DOCUMENTS

| | | | | |
|---|---|---|---|---|
| 6,296,441 | B1 * | 10/2001 | Gozdawa | F04D 25/0606 415/180 |
| 7,263,978 | B2 * | 9/2007 | York | F04B 49/20 123/41.31 |
| 2004/0037719 | A1 * | 2/2004 | Sunaga | F04D 29/588 417/423.8 |

FOREIGN PATENT DOCUMENTS

| | | | |
|---|---|---|---|
| EP | 0976917 | A2 | 2/2000 |
| EP | 1707823 | A2 | 10/2006 |
| EP | 1881200 | A1 | 1/2008 |
| JP | 06-101686 | A | 4/1994 |
| JP | 2002-138990 | A | 5/2002 |
| JP | 2004-346774 | A | 12/2004 |
| KR | 10-2011-0127309 | A | 11/2011 |

* cited by examiner

WATER PUMP IN VEHICLE

CROSS REFERENCE TO RELATED APPLICATION

This application claims the benefit of the Patent Korean Application No. 10-2012-0017041, filed on Feb. 20, 2012, which is hereby incorporated by reference as if fully set forth herein.

BACKGROUND OF THE DISCLOSURE

1. Field of the Disclosure

The present invention relates to water pumps in vehicles, and more particularly, to a water pump in a vehicle, in which cooling water is guided to an inside of the water pump for dissipating heat.

2. Discussion of the Related Art

In general, the vehicle is provided with an engine cooling unit for maintaining a temperature of the engine to a proper level, and cooling the engine slowly to enable smooth operation of the engine.

The engine cooling unit includes a radiator, cooling fan, a thermostat, the water pump, and an operation belt, wherein the cooling water is drawn from the radiator by the water pump, circulates through an intake manifold, an exhaust manifold, and a water jacket in a cylinder head, and returns to the radiator again, to cooling down the engine.

In the meantime, the water pump in the vehicle itself also generates intense heat due to rotation of the rotor and so on, and there have been many researches for resolving the intense heat generated when the water pump in the vehicle is in operation.

SUMMARY OF THE DISCLOSURE

Accordingly, the present invention is directed to a water pump in a vehicle.

An object of the present invention, devised to solve above problem, is to provide a water pump in a vehicle, which does not require machining of a shaft to be projected from a rotor for rotation of the rotor.

Another object of the present invention is to provide a water pump in a vehicle, which has a stator enclosed from an outside to prevent foreign matter from infiltrating therein.

Another object of the present invention is to provide a water pump in a vehicle, which can prevent the water pump from being damaged by heat, and has an improved heat dissipation performance.

Another object of the present invention is to provide a water pump in a vehicle, which can dissipate heat from a driving unit of the water pump having the driving unit mounted thereto, easily.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a water pump in a vehicle includes a pump cover which forms an upper side exterior appearance of the pump for housing an impeller to be rotated, a hollow rotor coupled on the same axis with the impeller to rotate altogether, and a housing coupled to the pump cover to house the rotor and a stator therein, wherein the pump cover includes a first rotation shaft extended toward the hollow in the rotor passed through the impeller, the housing includes a second rotation shaft extended toward the hollow in the rotor, the first rotation shaft has a communication hole formed therein to be in communication with the hollow, and the rotor has a communication passage recessed in a lower end portion thereof to a predetermined depth.

The communication passage may be formed adjacent to the second rotation shaft.

The communication passage may be plural arranged spaced from one another.

The communication passage may be four arranged at 90 degree intervals.

The communication passage may be tapered such that the communication passage becomes the deeper as the communication passage goes toward an underside of the rotor the more.

The communication passage may include a moderately curved surface.

The water pump may further include an ancillary impeller on a side of the impeller facing the rotor for applying a pressure to water to move the water.

The first rotation shaft and the second rotation shaft may have the same rotation axis.

The first rotation shaft may be directed to one end of the hollow in the rotor, and the second rotation shaft may be directed to the other end of the hollow in the rotor.

The first rotation shaft and the second rotation shaft may be arranged spaced from each other.

In another aspect of the present invention, a water pump in a vehicle includes a pump cover which forms an upper side exterior appearance of the pump for housing an impeller to be rotated, a hollow rotor coupled on the same axis with the impeller to rotate altogether, a housing coupled to the pump cover to house the rotor and a stator therein, and a driving unit mounted to an underside of the housing for controlling the stator, wherein the pump cover includes a first rotation shaft extended toward the hollow in the rotor passed through the impeller, the housing includes a second rotation shaft extended toward the hollow in the rotor, the first rotation shaft has a communication hole formed therein to be in communication with the hollow, and the rotor has a communication passage recessed in a lower end portion thereof to a predetermined depth.

The communication passage may be formed adjacent to the second rotation shaft.

The communication passage may be plural arranged spaced from one another.

The communication passage may be tapered such that the communication passage becomes the deeper as the communication passage goes toward an underside of the rotor the more.

The communication passage may include a moderately curved surface.

The water pump may further include an ancillary impeller on a side of the impeller facing the rotor for applying a pressure to water to move the water.

The driving unit may include a driving unit body extended from the housing, and a driving unit cover for enclosing an inside space of the driving unit body.

The driving unit body may have a PCB mounted thereto.

The driving unit cover may have heat dissipation pins mounted thereto for dissipating heat.

The first rotation shaft may be directed to one end of the hollow in the rotor, and the second rotation shaft may be directed to the other end of the hollow in the rotor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
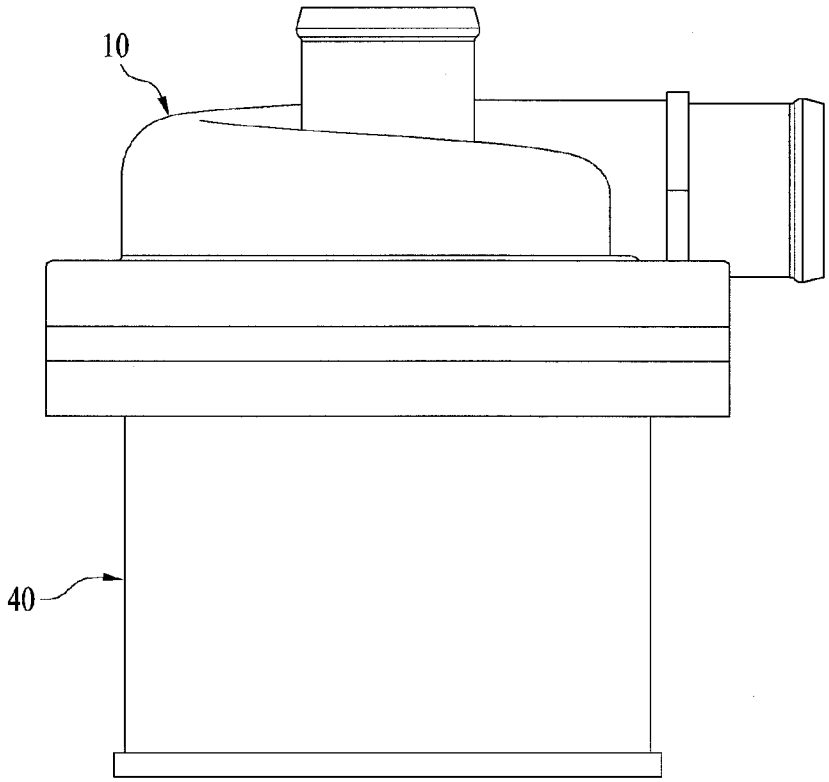
FIG. 1 illustrates a front view of a water pump in a vehicle in accordance with a preferred embodiment of the present invention.

FIG. 1 illustrates a front view of a water pump in a vehicle in accordance with a preferred embodiment of the present invention. The water pump in the vehicle in accordance with the preferred embodiment of the present invention will be described with reference to FIG. 1.

Referring to FIG. 1, the water pump in the vehicle includes a pump cover 10 which forms an upper side of an exterior appearance of the pump, and a housing 40 which forms a lower side of the exterior appearance of the pump. The housing 40 is mounted to an underside of the pump cover 10.

Figure 2:
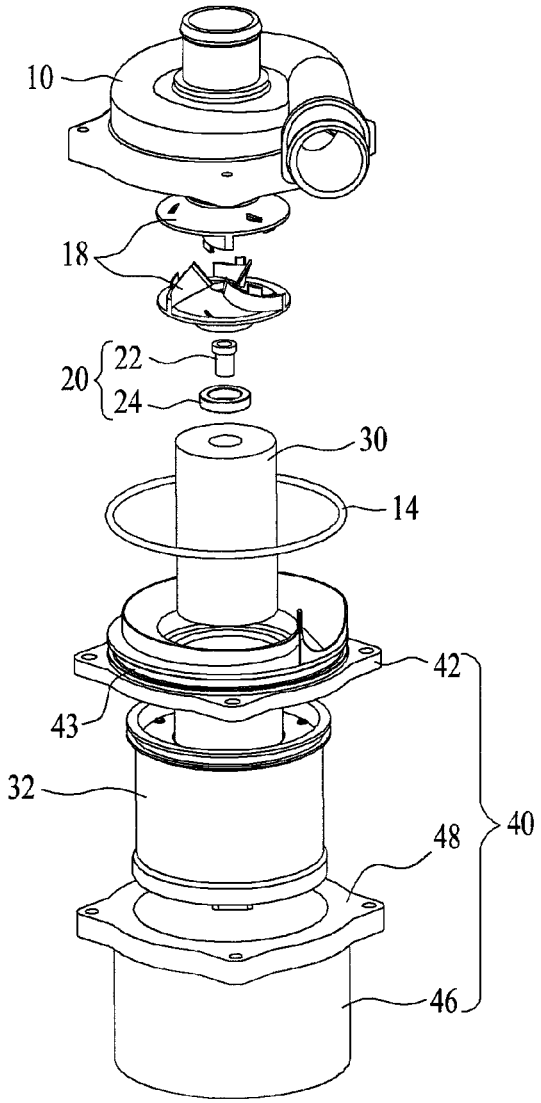
FIG. 2 illustrates an exploded perspective view of the water pump in FIG. 1.
Figure 3:
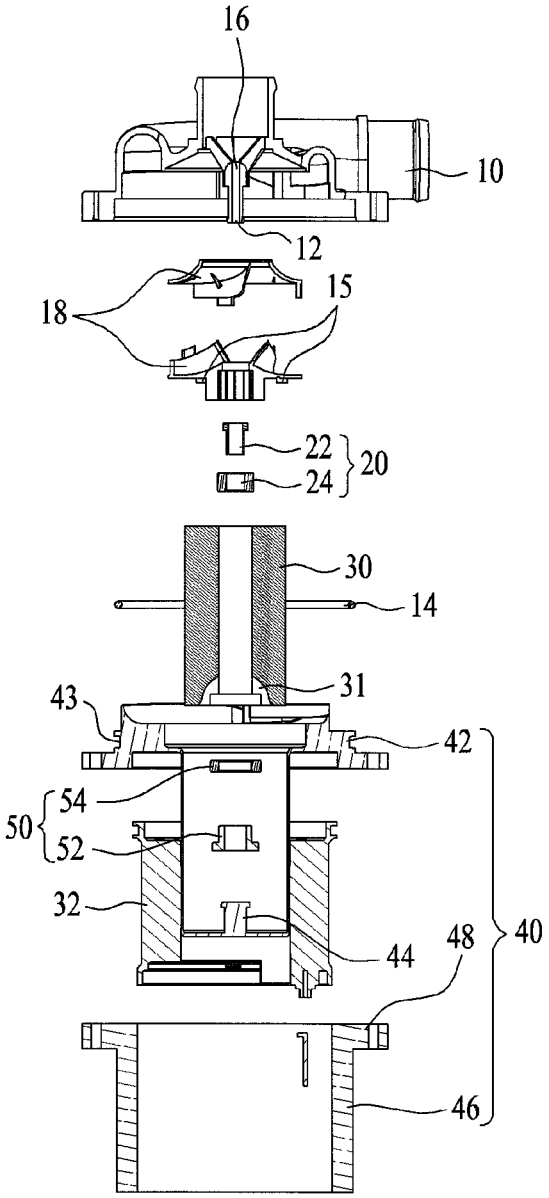
FIG. 3 illustrates a sectional exploded view of the water pump in FIG. 2.
Figure 4:
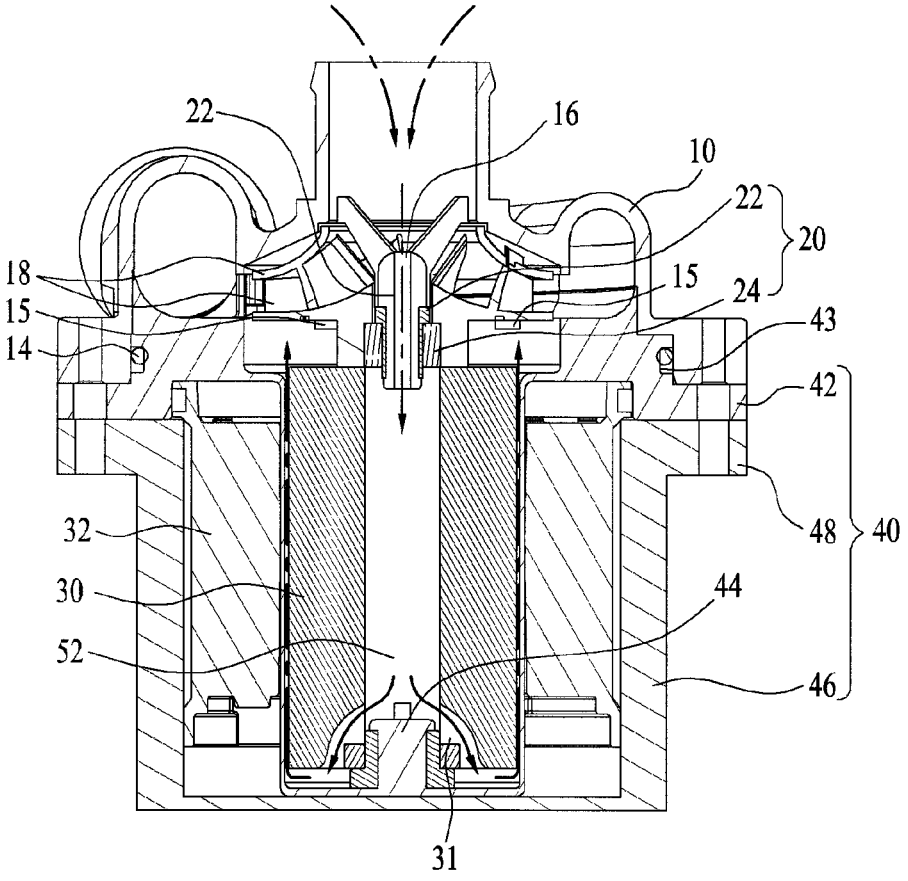
FIG. 4 illustrates a sectional view of the water pump in FIG. 1.

FIG. 2 illustrates an exploded perspective view of the water pump in FIG. 1, FIG. 3 illustrates a sectional exploded view of the water pump in FIG. 2, and FIG. 4 illustrates a sectional view of the water pump in FIG. 1.

Referring to FIGS. 2 to 4, the water pump includes the pump cover 10 for housing an impeller 18 to be rotated, a hollow rotor 30 coupled on the axis with the impeller 18 to rotate altogether, and the housing 40 for housing the rotor 30 and a stator 32 therein.

The rotor 30 has a cylindrical hollow formed therein, and the hollow has no outward shaft projected therefrom. That is, the rotor 30 has a cylindrical shape with the hollow with opened ends extended from a vacant inside. Particularly, the rotor 30 has a communication passage 31 recessed to a predetermined depth in a lower end portion thereof.

The stator 32 has a configuration identical to a stator used in a general water pump, of which description will be omitted.

It is preferable that the impeller 18 has a plurality of blades for applying rotation force to water to generate a water pressure, and a pass through hole formed in a center thereof. The water can move as the water is brought into contact with the blades. There is a first rotation shaft 12 to be described hereafter placed in the pass through hole in the impeller 18.

And, there may an ancillary impeller 15 at a side of the impeller 18 facing the rotor 30 for applying a pressure to the water to make the water to move. The ancillary impeller 15 can make the water to move along a flow passage owing to the rotation force of the impeller 18. In the meantime, the ancillary impeller 15 arranged to face the rotor 30 for applying the pressure to the water positioned on an upper side of the rotor 30.

It is possible that the impeller 18 is fixed to the rotor 30 by insert injection molding, thermal bonding, or an adhesive so that the impeller 18 rotates at a speed the same with the rotor 30. Of course, any structure may be employed as far as the structure can make the impeller 18 to rotate at the same time with the rotor 30 when the rotor 30 rotates, and to stop at the same time with the rotor 30 when the rotor 30 stops. Especially, it is possible to employ different structures that can connect the impeller 18 and the rotor 30 into a state in which the impeller 18 and the rotor 30 become one body.

In the meantime, the pump cover 10 includes the first rotation shaft 12 extended toward the hollow in the rotor 30 passed through the impeller 18, and the housing 40 includes a second rotation shaft 44 extended toward the hollow in the rotor 30. That is, the preferred embodiment of the present invention suggests providing no rotation shaft to the rotor 30 to make the rotor 30 to rotate, so that the rotor 30 has a simple structure of a substantially cylindrical shape, thereby enabling easy manufacturing of the rotor 30.

The rotor 30 has both ends rotatably secured by the first rotation shaft 12 and the second rotation shaft 44. In this case, it is preferable that the first rotation shaft 12 and the second rotation shaft 44 have the same rotation axis. It is because, in order to make the rotor 30 to be rotated stationary with respect to the first rotation shaft 12 and the second rotation shaft 44, it is required that all of the rotor 30, the first rotation shaft 12, and the second rotation shaft 44 are coupled on the same axis.

In this case, the first rotation shaft 12 has a communication hole 16 formed therein in communication with the hollow in the rotor 30. The communication hole 16 may be cylindrical which makes one end and the other end of the first rotation shaft 12 to be in communication with each other. That is, the communication hole 16 enables the water to move from the upper side of the first rotation shaft 12 to a lower side of the first rotation shaft 12, allowing introduction of the water to an inside of the rotor 30.

Of course, the first rotation shaft 12 is directed to the one end of the hollow in the rotor 30, and the second rotation shaft 44 is directed to the other end of the hollow in the rotor 30. One end of the rotor 30 at a center of the hollow is secured to the first rotation shaft 12, and the other end of the rotor 30 at the center of the hollow is secured to the second rotation shaft 44. In this case, since the first rotation shaft 12 and the second rotation shaft 44 are individual elements which are not in contact with each other, the rotor 30 is made to maintain a state in which the rotor 30 is secured to two points of the first rotation shaft 12 and the second rotation shaft 44.

The housing 40 may include a housing cover 42 for housing the rotor 30, and a housing body 46 for housing the housing cover 42. It is possible that the housing cover 42 has a 'T' shape, substantially.

The housing cover 42 has the rotor 30 housed therein. Mounted between the housing cover 42 and the housing body 46, there is the stator 32. That is, in an enclosed space between the housing cover 42 and the housing body 46, the stator 32 may be housed in an enclosed mode.

Provided on an upper side of the housing body 46, there may be a flange 48 extended in a radial direction from a center of the housing body 46. In this case, the flange 48 is coupled to an outside circumferential surface of the housing cover 42 for preventing the stator 32 housed in the housing body 46 from being exposing to an outside of the water pump. Since the housing cover 42 also has a 'T' shape on the whole, an outer portion of the housing cover 42 may coupled to the flange 48 at the housing body 46.

That is, since the stator 32 can be housed in the space enclosed between the housing cover 42 and the housing body 46, bringing into contact of foreign matter, such as water, to the stator 32 can be prevented.

Particularly, the second rotation shaft 44 can be provided to the housing cover 42. In this case, the second rotation shaft 44 is extended toward the pump cover 10, i.e., the other end of the rotor 30. The housing cover 42 may have the rotor 30 housed therein, by rotatably securing one end of the rotor 30 to the second rotation shaft 44 projected a predetermined length from the housing cover 42.

The first rotation shaft 12 and the second rotation shaft 44 are arranged spaced from each other. The first rotation shaft 12 is an element mounted to the pump cover 10, and the second rotation shaft 44 is an element mounted to the housing cover 42 separate from the first rotation shaft 12. Since the first rotation shaft 12 is not in contact with the second rotation shaft 44 directly, the inside of the rotor 30 may have a vacant hollow space which is not filled with the first rotation shaft 12 and the second rotation shaft 44. The vacant hollow space in the rotor 30 as much as a space the first rotation shaft 12 and the second rotation shaft 44 are spaced away, the water pump of the embodiment can save material cost in comparison to a shape in which a rotation shaft is projected from both sides without the hollow in the rotor 30.

Moreover, the first rotation shaft 12 and the second rotation shaft 44 have diameters smaller than a diameter of the hollow in the rotor 30. This is because, in order to make the rotor 30 to rotate with respect to the first rotation shaft 12 and the second rotation shaft 44 with small friction, it is required to mount a first bearing 20 to the first rotation shaft 12 and a second bearing 50 to the second rotation shaft 44.

The first rotation shaft 12 has the first bearing 20 provided thereto to make the rotor 30 to rotate at a rotation speed the same with the impeller 18. The first bearing 20 may include first connection means 22 mounted to an outside circumferential surface of the first rotation shaft 12, and a first friction preventive means 24 mounted to an outside circumferential surface of the first connection means 22.

The first connection means 22 serves as a medium for preventing the rotor 30, the impeller 18 and the first rotation shaft 12 from being in direct contact with one another. Since the first connection means 22 can rotate centered on the first rotation shaft 12, the first connection means 22 enables the rotor 30, and the impeller 18 to rotate independent from the first rotation shaft 12, smoothly. It is possible that the first connection means 22 is formed of ceramic.

Though the first friction preventive means 24 also serves a function similar to the first connection means 22 substantially, the first friction preventive means 24 is different in that the first friction preventive means 24 is in direct contact to the rotor 30. It is possible that the first friction preventive means 24 is formed of SiC. That is, the first friction preventive means 24 has strength stronger than the first connection means 22, on the whole.

Of course, though FIG. 3 discloses a mode in which the first bearing 20 makes the impeller 18 and the first rotation shaft 12 to be coupled coaxially, it is possible to change the mode such that the first bearing 20 is shifted down to a position lower than shown in FIG. 3 to make the rotor 30 and the first rotation shaft 12 to be coupled coaxially. In this case, the first friction preventive means 24 may rotate in contact with an inside circumferential surface of the rotor 30.

In the meantime, the second rotation shaft 44 has the second bearing 50 provided thereto for enabling the rotor 30 to rotate. It is possible that the second bearing 50 may include second connection means 52 mounted to an outside circumferential surface of the second rotation shaft 44, and second friction preventive means 54 mounted to an outside circumferential surface of the second connection means 52. In this case, the outside circumferential surface of the second friction preventive means 54 may be in contact with the inside circumferential surface of the rotor 30.

The second connection means 52 serves as a medium for preventing the rotor 30 from being in direct contact with the second rotation shaft 44. Since the second connection means 52 can rotate centered on the second rotation shaft 44, the rotor 30 is made to rotate smoothly independent from the second rotation shaft 44. It is possible that the second connection means 52 is formed of ceramic.

Though the second friction preventive means 54 also serves a function similar to the second connection means 52 substantially, the second friction preventive means 54 is different in that the second friction preventive means 54 is in direct contact to the rotor 30. It is possible that the second friction preventive means 54 is formed of SiC. That is, the second friction preventive means 54 has strength stronger than the second connection means 52, on the whole.

A reference number 14 denotes an O-ring for sealing a gap between the pump cover 10 and the housing cover 42 when the pump cover 10 is coupled to the housing cover 42. In this case, the O-ring 14 may be formed of rubber seated in a seating groove 43 formed in the housing cover 42.

In the meantime, it is preferable that the communication passage 31 formed in the rotor 30 is adjacent to the second rotation shaft 44. Particularly, the communication passage 31 may be formed adjacent to the second bearing 50.

The communication passage 31 may be tapered to make a depth thereof to become the deeper as the communication passage 31 goes toward the underside of the rotor 30 the more. That is, the depth of the communication passage 31 becomes the deeper as the communication passage 31 goes to the underside of the rotor 30 the more, resulting in a thickness of a portion of the rotor 30 to be the thinner as the communication passage 31 goes toward the underside of the rotor 30 the more.

Particularly, the communication passage 31 may include a moderately curved surface. That is, it is preferable that an outside circumferential surface of the communication passage 31 in a radial direction from a center of the rotor 30 is moderately curved. This is for making the water flowing through the communication passage 31 moves to the underside of the rotor 30 along the moderately curved surface, smoothly.

Figure 5:
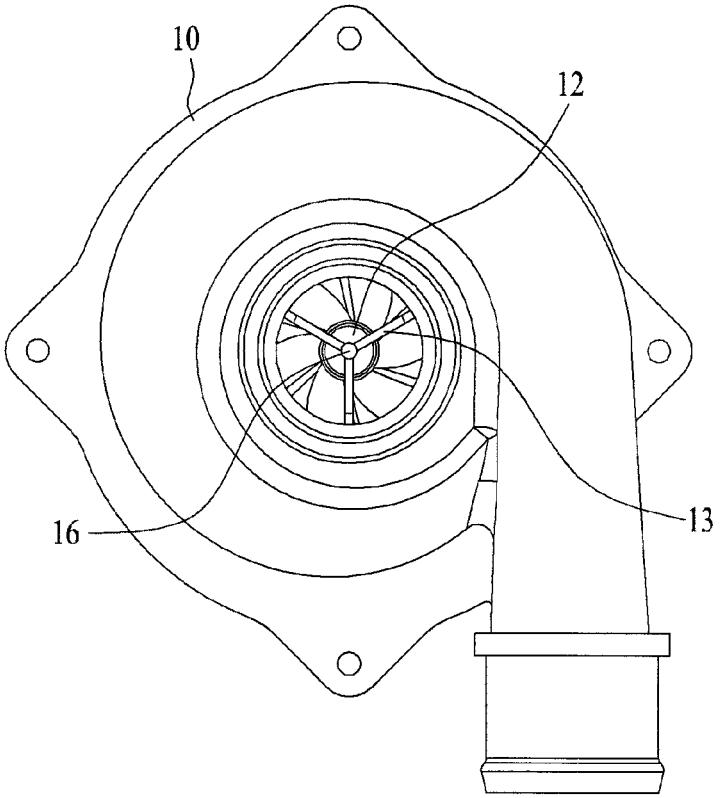
FIG. 5 illustrates a plan view of a pump cover.

FIG. 5 illustrates a plan view of a pump cover. The communication hole will be described with reference to FIG. 5, in detail.

The communication hole 16 is formed to pass through the first rotation shaft 12 in a center of the first rotation shaft 12. That is, the communication hole 16 provides an inlet of the water positioned on an upper side of the pump cover 10, i.e., on an outside of the pump cover 10, to be able to be introduced to a lower side of the pump cover 10, i.e., to an inside of the water pump.

In the meantime, the first rotation shaft 12 can be secured by a bracket 13. Since the first rotation shaft 12 has the communication hole 16 formed therein, a problem may take place in that strength of the first rotation shaft 12 becomes weak. Therefore, it is possible to secure the first rotation shaft 12 with a plurality of the brackets 13, fixedly.

Figure 6:
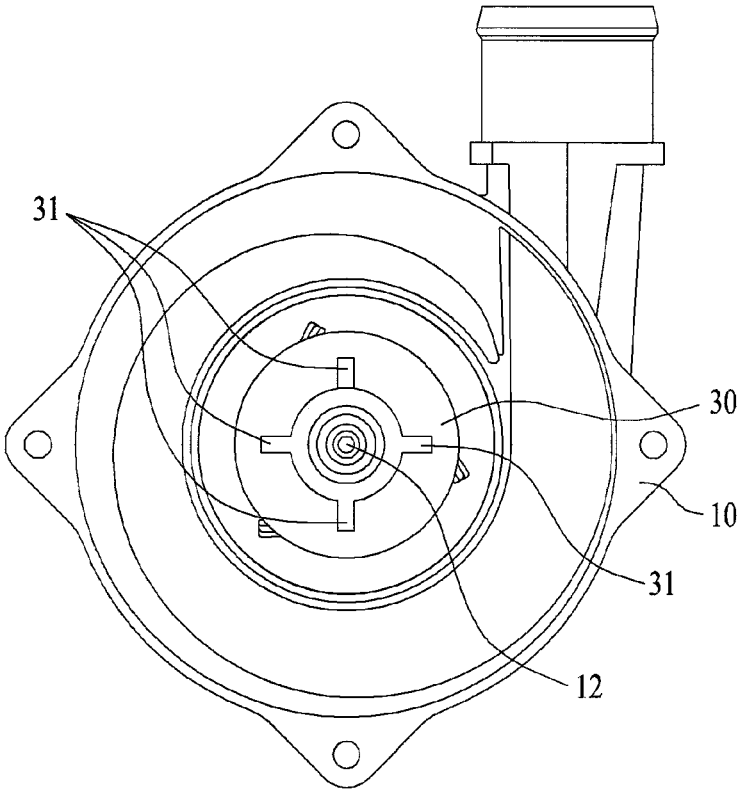
FIG. 6 illustrates a bottom view of a pump cover with a rotor mounted thereto.

FIG. 6 illustrates a bottom view of a pump cover with a rotor mounted thereto. The communication passage will be described with reference to FIG. 6, in detail.

The communication passage 31 may be formed in plural in a lower end portion of the rotor 30. In this case, the plurality of communication passages 31 may be arranged to space from one another at fixed angular intervals. Particularly, the communication passages 31 may be four arranged at 90 degree intervals.

Of course, if the communication passages 31 are three, the communication passages 31 may be arranged at 120 degree intervals.

An increased number of the communication passages 31 are advantageous in that a space increases, through which the water positioned in the rotor 30 is discharged to the underside of the rotor 30 through the communication passages 31. However, unnecessary increase of the number of the communication passages 31 may cause a risk of securing force lost when the rotor 30 rotates coupled to the second rotation shaft 44. Therefore, it is preferable that the communication passages 31 are about 3 to 4.

The operation of the water pump in accordance with the preferred embodiment of the present invention will be described.

Both ends of the rotor 30 are rotatably coupled on the same axis through axes of the first rotation shaft 12 and the second rotation shaft 44, respectively. Owing to the first bearing 20 and the second bearing 50, the rotor 30 can rotate without causing high friction with respect to the first rotation shaft 12 and the second rotation shaft 44.

When the rotor 30 rotates, the impeller 18 can also rotates at the same speed with the rotor 30. According to this, the water pressure generated by the impeller 18 enables the water pump to discharge or draw in the water.

Above description explains movement of the water for cooling different elements of the engine according to an original purpose of the water pump. Other than above operation, the water pump in accordance with the preferred embodiment of the present invention may also perform a function of cooling down the water pump by introducing the water to the inside of the water pump.

When the rotor 30 and the impeller 18 rotate, the movement of the water takes place. In this case, a portion of the water positioned on the upper side of the pump cover 10 passes through the first rotation shaft 12 through the communication hole 16.

Then, the water moves to the inside of the rotor 30, and reaches to the communication passage 31 as the water moves down to a lower side of the rotor 30.

Since the rotor 30 rotates, the water positioned in the communication passage 31 moves to the underside of the rotor 30 owing to centrifugal force generated by rotation of the communication passage 31. This is because the communication passage 31 has the moderately curved inside circumferential surface of the rotor 30 in the radial direction from the center of the rotor 30, and becomes the deeper as the communication passage 31 goes to the underside the more.

In this case, since the moderately curved surface is smoothly curved, the water can move along the communication passage 31, easily.

The water discharged to the outside of the rotor 30 from the inside of the rotor 30 through the communication passage 31 moves to the upper side of the water pump along an outside circumferential surface of the rotor 30, again. In this case, since the impeller 18 is rotating, the ancillary impeller 15 under the impeller 18 is also rotating. Therefore, the ancillary impeller 15 enables the water positioned under the rotor 30 to move to the upper side of the rotor 30, and therefrom, to the outside of the water pump, finally.

Thus, as the water is brought into contact with different elements of the rotor 30 and the water pump, the heat generated as the water pump is operated can transfer to the water. According to this, the water pump can be cooled down.

In the meantime, in the embodiment of the present invention, in order to make the water to move in the water pump smoothly, the communication passage 31 is formed to have a special shape, and the ancillary impeller 15 is provided, additionally. That is, since the communication passage 31 and the ancillary impeller 15 apply a pressure to the water while the communication passage 31 and the ancillary impeller 15 are rotating at the same time, the water in the water pump can move to a desired flow passage, smoothly.

Figure 7:
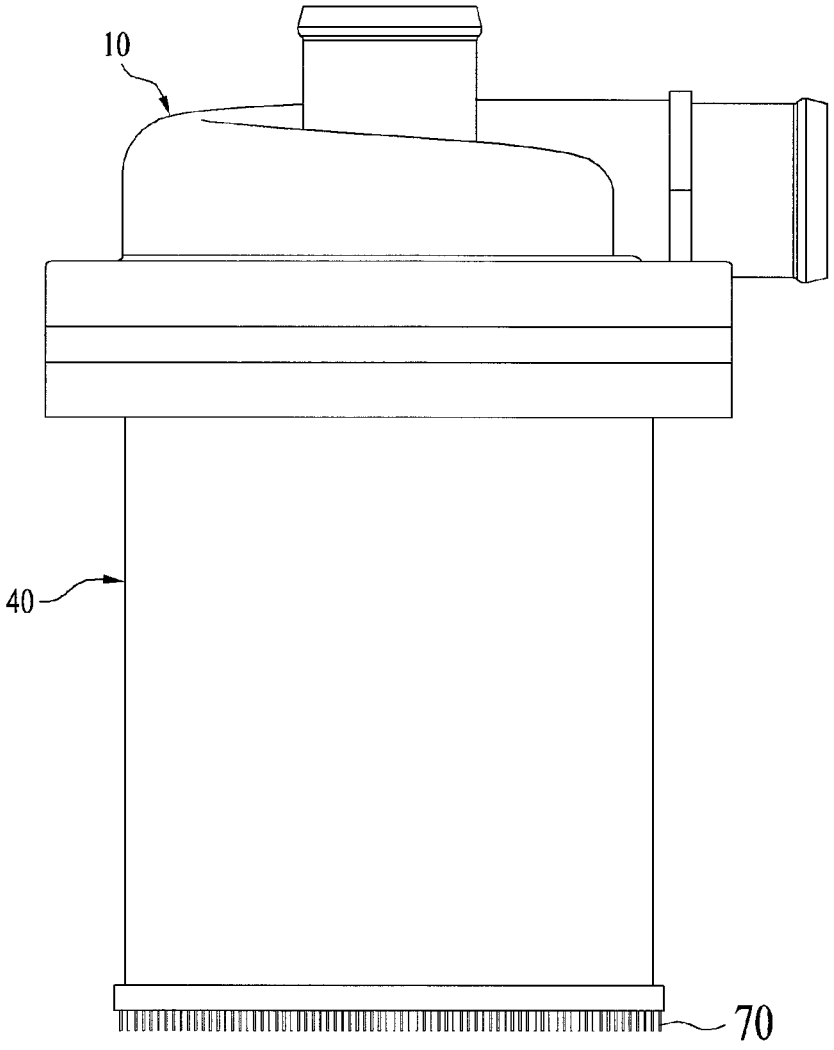
FIG. 7 illustrates a front view of a water pump in a vehicle in accordance with another preferred embodiment of the present invention.

FIG. 7 illustrates a front view of a water pump in a vehicle in accordance with another preferred embodiment of the present invention. The water pump in a vehicle in accordance with another preferred embodiment of the present invention will be described with reference to FIG. 7.

Referring to FIG. 7, the water pump includes a pump cover 10 which forms an upper side of an exterior appearance of the water pump, and a housing 40 which forms a lower side of the exterior appearance of the pump. The housing 40 is mounted to an underside of the pump cover 10.

Particularly, the housing 40 has heat dissipation pins 70 on an underside of the housing 40 for dissipating heat generated at the water pump to an outside of the water pump.

In the meantime, since the water pump in accordance with another preferred embodiment of the present invention has the communication passage and the communication hole identical to the water pump in accordance with the preferred embodiment of the present invention, FIGS. 5 and 6 will be referred to the same as the preferred embodiment of the present invention. Therefore, since description of the communication hole and the communication passage in the preferred embodiment of the present invention is the same with another preferred embodiment of the present invention, identical description will be omitted.

Figure 8:
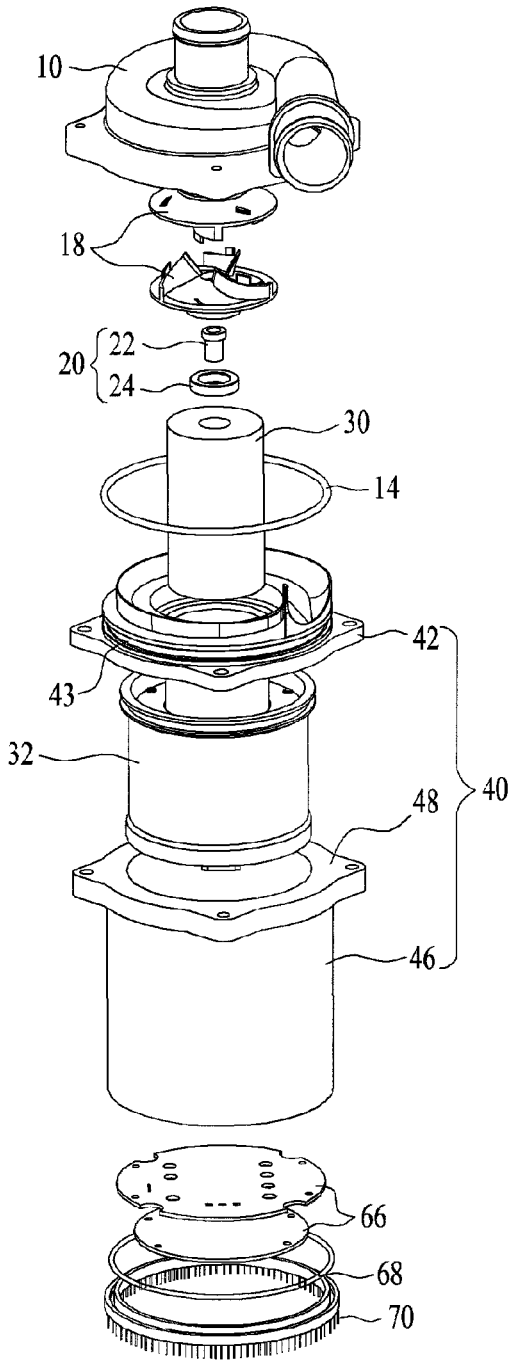
FIG. 8 illustrates an exploded perspective view of the water pump in FIG. 7.
Figure 9:
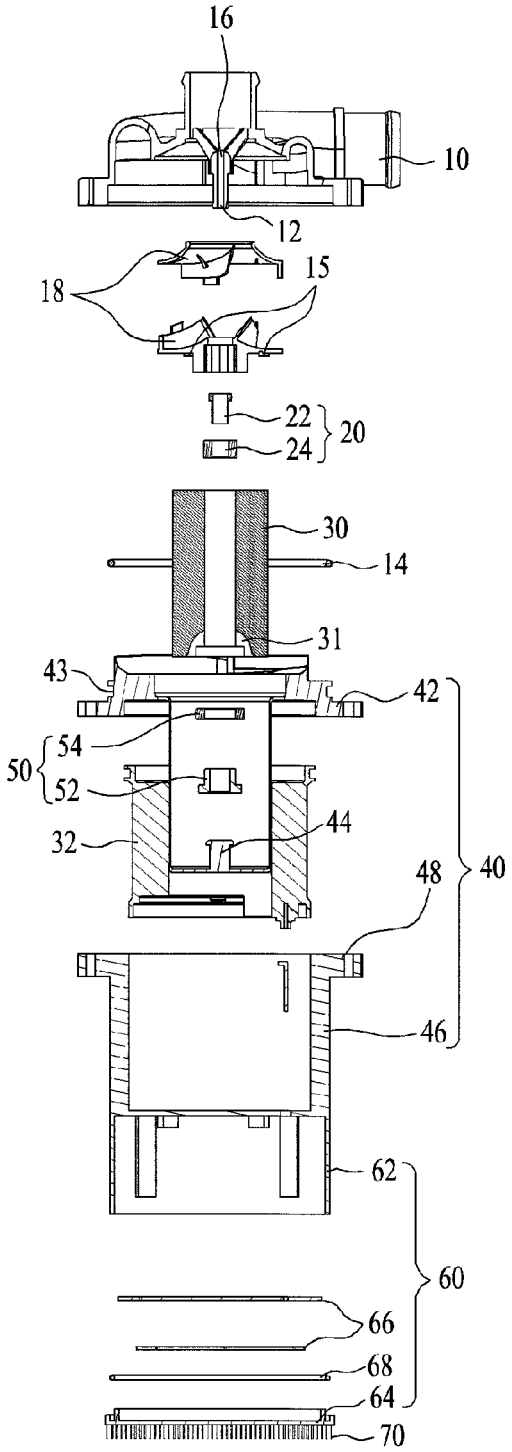
FIG. 9 illustrates a sectional exploded view of the water pump in FIG. 8.
Figure 10:
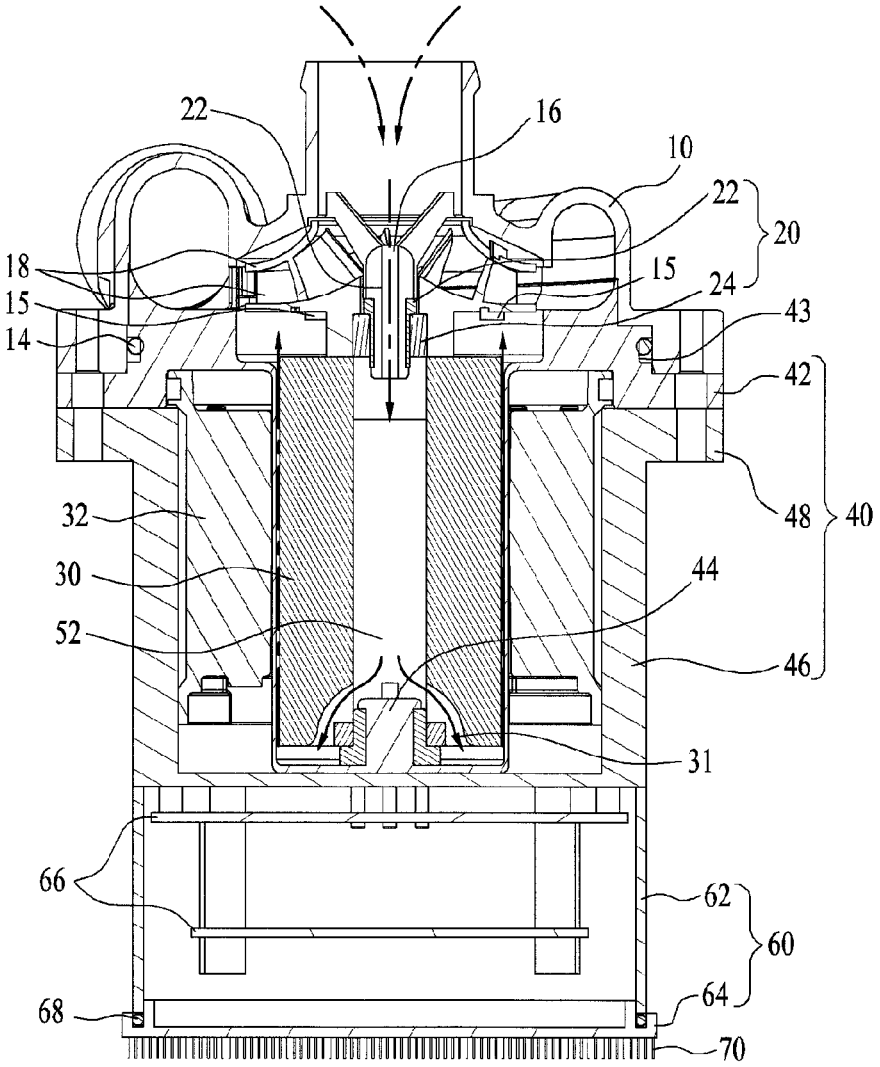
FIG. 10 illustrates a sectional view of the water pump in FIG. 7.

FIG. 8 illustrates an exploded perspective view of the water pump in FIG. 7, FIG. 9 illustrates a sectional exploded view of the water pump in FIG. 8, and FIG. 10 illustrates a sectional view of the water pump in FIG. 7.

Referring to FIGS. 8 to 10, the water pump includes the pump cover 10 for housing an impeller 18 to be rotated, a hollow rotor 30 coupled on the same axis with the impeller 18 to rotate altogether, and the housing 40 for housing the rotor 30 and a stator 32 therein.

The rotor 30 has a cylindrical hollow formed therein, and the hollow has no outward shaft projected therefrom. That is, the rotor 30 has a cylindrical shape with the hollow with opened ends extended from a vacant inside. Particularly, the rotor 30 has a communication passage 31 in a lower end portion thereof.

The stator 32 has a configuration identical to a stator used in a general water pump, of which description will be omitted.

It is preferable that the impeller 18 has a plurality of blades for applying rotation force to water to generate a water pressure, and a pass through hole formed in a center thereof. The water can move as the water is brought into contact with the blades. There is a first rotation shaft 12 to be described hereafter placed in the pass through hole in the impeller 18. The first rotation shaft 12 has a communication hole 16 formed therein to be in communication with the hollow in the rotor.

It is possible that the impeller 18 is fixed to the rotor 30 by insert injection molding, thermal bonding, or an adhesive so that the impeller 18 rotates at a speed the same with the rotor 30. Of course, any structure may be employed as far as the structure can make the impeller 18 to rotate at the same time with the rotor 30 when the rotor 30 rotates, and to stop at the same time with the rotor 30 when the rotor 30 stops. Especially, it is possible to employ different structures that can connect the impeller 18 and the rotor 30 into a state in which the impeller 18 and the rotor 30 become one body.

In the meantime, the pump cover 10 includes the first rotation shaft 12 extended toward the hollow in the rotor 30 passed through the impeller 18, and the housing 40 includes a second rotation shaft 44 extended toward the hollow in the rotor 30. That is, another preferred embodiment of the present invention suggests providing no rotation shaft to the rotor 30 to make the rotor 30 to rotate, so that the rotor 30 has a simple structure of a substantially cylindrical shape, thereby enabling easy manufacturing of the rotor 30.

The rotor 30 has both ends rotatably secured by the first rotation shaft 12 and the second rotation shaft 44. In this case, it is preferable that the first rotation shaft 12 and the second rotation shaft 44 have the same rotation axis. It is because, in order to make the rotor 30 to be rotated stationary with respect to the first rotation shaft 12 and the second rotation shaft 44, it is required that all of the rotor 30, the first rotation shaft 12, and the second rotation shaft 44 are coupled on the same axis.

Of course, the first rotation shaft 12 is directed to the one end of the hollow in the rotor 30, and the second rotation shaft 44 is directed to the other end of the hollow in the rotor 30. One end of the rotor 30 at a center of the hollow is secured to the first rotation shaft 12, and the other end of the rotor 30 at the center of the hollow is secured to the second rotation shaft 44. In this case, since the first rotation shaft 12 and the second rotation shaft 44 are individual elements which are not in contact with each other, the rotor 30 is made to maintain a state in which the rotor 30 is secured to two points of the first rotation shaft 12 and the second rotation shaft 44.

The housing 40 may include a housing cover 42 for housing the rotor 30, and a housing body 46 for housing the housing cover 42. It is possible that the housing cover 42 has a 'T' shape, substantially.

The housing cover 42 has the rotor 30 housed therein. Mounted between the housing cover 42 and the housing body 46, there is the stator 32. That is, in an enclosed space between the housing cover 42 and the housing body 46, the stator 32 may be housed in an enclosed mode.

Provided on an upper side of the housing body 46, there may be a flange 48 extended in a radial direction from a center of the housing body 46. In this case, the flange 48 is coupled to an outside circumferential surface of the housing cover 42 for preventing the stator 32 housed in the housing body 46 from being exposing to an outside of the water pump. Since the housing cover 42 also has a 'T' shape on the whole, an outer portion of the housing cover 42 may coupled to the flange 48 at the housing body 46.

That is, since the stator 32 can be housed in the space enclosed between the housing cover 42 and the housing body 46, bringing into contact of foreign matter, such as water, to the stator 32 can be prevented.

Particularly, the second rotation shaft 44 can be provided to the housing cover 42. In this case, the second rotation shaft 44 is extended toward the pump cover 10, i.e., the other end of the rotor 30. The housing cover 42 may have the rotor 30 housed therein, by rotatably securing one end of the rotor 30 to the second rotation shaft 44 projected a predetermined length from the housing cover 42.

The first rotation shaft 12 and the second rotation shaft 44 are arranged spaced from each other. The first rotation shaft 12 is an element mounted to the pump cover 10, and the second rotation shaft 44 is an element mounted to the housing cover 42 separate from the first rotation shaft 12. Since the first rotation shaft 12 is not in contact with the second rotation shaft 44 directly, the inside of the rotor 30 may have a vacant hollow space which is not filled with the first rotation shaft 12 and the second rotation shaft 44. The vacant hollow space in the rotor 30 as much as a space the first rotation shaft 12 and the second rotation shaft 44 are spaced away, the water pump of the embodiment can save material cost in comparison to a shape in which a rotation shaft is projected from both sides without the hollow in the rotor 30.

Moreover, the first rotation shaft 12 and the second rotation shaft 44 have diameters smaller than a diameter of the hollow in the rotor 30. This is because, in order to make the rotor 30 to rotate with respect to the first rotation shaft 12 and the second rotation shaft 44 with small friction, it is required to mount a first bearing 20 to the first rotation shaft 12 and a second bearing 50 to the second rotation shaft 44.

The first rotation shaft 12 has the first bearing 20 provided thereto to make the rotor 30 to rotate at a rotation speed the same with the impeller 18. The first bearing 20 may include first connection means 22 mounted to an outside circumferential surface of the first rotation shaft 12, and a first friction preventive means 24 mounted to an outside circumferential surface of the first connection means 22.

The first connection means 22 serves as a medium for preventing the rotor 30, the impeller 18 and the first rotation shaft 12 from being in direct contact with one another. Since the first connection means 22 can rotate centered on the first rotation shaft 12, the first connection means 22 enables the rotor 30, and the impeller 18 to rotate independent from the first rotation shaft 12, smoothly. It is possible that the first connection means 22 is formed of ceramic.

Though the first friction preventive means 24 also serves a function similar to the first connection means 22 substantially, the first friction preventive means 24 is different in that the first friction preventive means 24 is in direct contact to the rotor 30. It is possible that the first friction preventive means 24 is formed of SiC. That is, the first friction preventive means 24 has strength stronger than the first connection means 22, on the whole.

Of course, though FIG. 10 discloses a mode in which the first bearing 20 makes the impeller 18 and the first rotation shaft 12 to be coupled coaxially, it is possible to change the mode such that the first bearing 20 is shifted down to a position lower than shown in FIG. 10 to make the rotor 30 and the first rotation shaft 12 to be coupled coaxially. In this case, the first friction preventive means 24 may rotate in contact with an inside circumferential surface of the rotor 30.

In the meantime, the second rotation shaft 44 has the second bearing 50 provided thereto for enabling the rotor 30 to rotate. It is possible that the second bearing 50 may include second connection means 52 mounted to an outside circumferential surface of the second rotation shaft 44, and second friction preventive means 54 mounted to an outside circumferential surface of the second connection means 52. In this case, the outside circumferential surface of the second friction preventive means 54 may be in contact with the inside circumferential surface of the rotor 30.

The second connection means 52 serves as a medium for preventing the rotor 30 from being in direct contact with the second rotation shaft 44. Since the second connection means 52 can rotate centered on the second rotation shaft 44, the rotor 30 is made to rotate smoothly independent from the second rotation shaft 44. It is possible that the second connection means 52 is formed of ceramic.

Though the second friction preventive means 54 also serves a function similar to the second connection means 52 substantially, the second friction preventive means 54 is different in that the second friction preventive means 54 is in direct contact to the rotor 30. It is possible that the second friction preventive means 54 is formed of SiC. That is, the second friction preventive means 54 has strength stronger than the second connection means 52, on the whole.

A reference number 14 denotes an O-ring for sealing a gap between the pump cover 10 and the housing cover 42 when the pump cover 10 is coupled to the housing cover 42. In this case, the O-ring 14 may be formed of rubber seated in a seating groove 43 formed in the housing cover 42.

The water pump in a vehicle in accordance with another preferred embodiment of the present invention further includes a driving unit 60 mounted on an underside of the housing 40 for controlling the stator 32. Of course, the driving unit 60 may control different elements of the water pump in addition to the stator 32.

The driving unit 60 includes a driving unit body 62 extended from the housing 40, and a driving unit cover 64 for enclosing an inside space of the driving unit body 62. The driving unit body 62 is arranged under the housing body 46, and, similar to the housing body 46, has an inside space for housing different elements therein. Particularly, the driving unit body 62 may have a PCB (Printed Circuit Body) mounted thereto.

And, the driving unit cover 64 may have heat dissipation pins 70 mounted thereto for dissipation of heat. A plurality of the heat dissipation pins 70 may be provided in a variety of shapes along a side of the driving unit cover 64. Of course, if there is a limitation in view of space, though the heat dissipation pins 70 may be projected from a portion of the driving unit cover 64, it is preferable that the heat dissipation pins 70 are projected throughout an entire surface of the one side of the driving unit cover 64 for improving heat efficiency.

The operation of the water pump in a vehicle in accordance with another preferred embodiment of the present invention will be described. Since another preferred embodiment is different from the preferred embodiment in that another preferred embodiment suggests to provide the driving unit and the heat dissipation pins, only the driving unit and the heat dissipation pins will be described.

The driving unit 60, particularly, the PCB 66, generates heat as the water pump is driven to raise a temperature of the water pump, which is liable to damage the water pump. Therefore, in this case, the heat transfers from the driving unit body 62 to the driving unit cover 64, and, therefrom, to an outside of the water pump through the heat dissipation pins 70.

As has been described, the water pump in a vehicle of the present invention has the following advantages.

Since the rotor has no shaft manufactured to be projected therefrom, manufacturing and assembly of the rotor can be improved.

The stable heat dissipation regardless of heat generation at the time of the operation of the water pump permits to prevent the water pump from becoming out of order.

The stator, not exposed to an outside, but enclosed in the water pump permits to prevent the stator from being damaged by foreign matter infiltrated thereto.

The easy dissipation of the heat from the driving unit permits to prevent not only the driving unit, but also the water pump from being damaged by intensive heat.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A water pump in a vehicle comprising:

a pump cover which forms an upper side exterior appearance of the pump for housing an impeller to be rotated;

a hollow rotor coupled on the same axis with the impeller to rotate altogether; and a housing coupled to the pump cover to house the rotor and a stator therein, wherein the pump cover includes a first rotation shaft extended toward the hollow in the rotor passed through the impeller, the housing includes a second rotation shaft extended toward the hollow in the rotor, the first rotation shaft has a communication hole formed therein to be in communication with the hollow, and the rotor has at least one communication passage recessed from an inner surface of a lower end portion of the hollow rotor in a radial direction.

2. The water pump as claimed in claim 1, wherein the communication passage is formed adjacent to the second rotation shaft.

3. The water pump as claimed in claim 2, wherein the at least one communication passage comprises a plurality of communication passages spaced apart from one another.

4. The water pump as claimed in claim 2, wherein the at least one communication passage comprises four communication passages spaced apart from one another at 90 degree intervals.

5. The water pump as claimed in claim 1, wherein a first horizontal depth of an upper portion of the communication passage is less than a second horizontal depth of a lower portion of the communication passage.

6. The water pump as claimed in claim 5, wherein the communication passage includes a curved surface.

7. The water pump as claimed in claim 1, further comprising an ancillary impeller on a side of the impeller facing the rotor for applying a pressure to water to move the water.

8. The water pump as claimed in claim 1, wherein the first rotation shaft and the second rotation shaft have the same rotation axis.

9. The water pump as claimed in claim 1, wherein the first rotation shaft is directed to an upper end of the hollow in the rotor, and the second rotation shaft is directed to a lower end of the hollow in the rotor.

10. The water pump as claimed in claim 1, wherein the first rotation shaft and the second rotation shaft are arranged spaced from each other.

11. A water pump in a vehicle comprising:

a pump cover which forms an upper side exterior appearance of the pump for housing an impeller to be rotated;

a hollow rotor coupled on the same axis with the impeller to rotate altogether;

a housing coupled to the pump cover to house the rotor and a stator therein; and a driving unit mounted to an underside of the housing for controlling the stator, wherein the pump cover includes a first rotation shaft extended toward the hollow in the rotor passed through the impeller, the housing includes a second rotation shaft extended toward the hollow in the rotor, the first rotation shaft has a communication hole formed therein to be in communication with the hollow, and the rotor has at least one communication passage recessed from an inner surface of a lower end portion of the hollow rotor in a radial direction.

12. The water pump as claimed in claim 11, wherein the communication passage is formed adjacent to the second rotation shaft.

13. The water pump as claimed in claim 12, wherein the at least one communication passage comprises a plurality of communication passages spaced apart from one another.

14. The water pump as claimed in claim 11, wherein a first horizontal depth of an upper portion of the communication passage is less than a second horizontal depth of a lower portion of the communication passage.

15. The water pump as claimed in claim 14, wherein the communication passage includes a curved surface.

16. The water pump as claimed in claim 11, further comprising an ancillary impeller on a side of the impeller facing the rotor for applying a pressure to water to move the water.

17. The water pump as claimed in claim 12, wherein the driving unit includes;

a driving unit body extended from the housing, and a driving unit cover for enclosing an inside space of the driving unit body.

18. The water pump as claimed in claim 17, wherein the driving unit body has a PCB mounted thereto.

19. The water pump as claimed in claim 18, wherein the driving unit cover has heat dissipation pins mounted thereto for dissipating heat.

20. The water pump as claimed in claim 11, wherein the first rotation shaft is directed to an upper end of the hollow in the rotor, and the second rotation shaft is directed to a lower end of the hollow in the rotor.

* * * * *